United States Patent [19]

Owen

[11] 3,964,738

[45] June 22, 1976

[54] CLAMP

[76] Inventor: Walter L. Owen, Rte. 2, Box 540, Gridley, Calif. 95948

[22] Filed: Aug. 6, 1975

[21] Appl. No.: 602,308

Related U.S. Application Data

[63] Continuation-in-part of Ser. No. 473,292, May 24, 1974, abandoned.

[52] U.S. Cl. ..... 269/221; 269/228; 269/236; 269/256

[51] Int. Cl.[2] ..... B25B 5/12

[58] Field of Search ..... 81/398, 399; 254/10 R, 254/122, 126; 269/201, 218, 221, 228, 233, 236, 256

[56] References Cited

UNITED STATES PATENTS

| | | | |
|---|---|---|---|
| 221,611 | 11/1879 | Ringstad | 269/256 |
| 1,259,218 | 3/1918 | Eriksen | 269/218 |
| 1,372,833 | 3/1921 | Saver | 269/221 |
| 2,592,807 | 4/1952 | Jones | 81/399 |
| 3,093,378 | 6/1963 | Aulner | 269/228 |
| 3,210,070 | 10/1965 | Lagana | 269/228 |
| 3,263,430 | 8/1966 | Bryan | 254/126 |

FOREIGN PATENTS OR APPLICATIONS

| | | | |
|---|---|---|---|
| 37,087 | 8/1952 | Sweden | 269/228 |

*Primary Examiner*—Roy Lake
*Assistant Examiner*—Mark S. Bicks
*Attorney, Agent, or Firm*—Clarence A. O'Brien; Harvey B. Jacobson

[57] ABSTRACT

A pair of work engaging jaws of a clamp device are interconnected by linkages forming part of a manually operable force multiplying mechanism. A movable work engaging element mounted by one of the jaws, is actuated by a grip lever from a retracted position into engagement with a workpiece. An over-center linkage transmits the actuating force against the resistance of a spring to prevent return of the grip lever from its actuated position. A release lever is actuated to cam the grip lever and retract the work engaging element.

12 Claims, 13 Drawing Figures

CLAMP

This is a continuation-in-part application of my copending application Ser. No. 473,292, filed May 24, 1974, for a CLAMP now abandoned.

BACKGROUND OF THE INVENTION

This invention relates to work holding clamp devices.

Many specialized and industrial clamp devices are available that are limited in practical use to workpieces within a certain size range. Examples of some previously known clamps are disclosed in U.S. Pat. Nos: 221,611; 1,259,218; 1,372,833; 2,592,807; 3,092,378; 3,210,070; 3,263,430; and Swedish Pat. No. 137,087.

Even so, a considerable amount of jaw adjustment is required each time material to be clamped is inserted between the jaws of the clamp. Also, release of the material from the clamp involves almost as much time for retraction of the jaws as advancement to the clamping position. Since a force multiplying mechanism is generally required to displace the jaws with the mechanical advantage necessary to exert the requisite holding pressure on the work being clamped, work engaging and releasing operations of the clamp device are slow and time consuming. This creates a production problem in the handling of material undergoing manufacturing processes.

BRIEF DESCRIPTION OF THE INVENTION

In accordance with the present invention, a pair of jaws are advanced toward each other at work engaging ends to within a predetermined distance exceeding the workpiece dimension by a small amount such as one-sixteenth of an inch. This initial adjustment is effected rather precisely by a force multiplying mechanism of special design. Actual engagement of the work or material between the clamp jaws is then effected by a snap-action displacement of a movable work engaging element mounted on one of the jaws. Further adjustment of the jaws by the force multiplying mechanism may then be effected, if necessary, to exert the requisite clamping pressure on the work. The force multiplying mechanism need not be disturbed thereafter for subsequent clamping of the same dimensioned workpieces.

Actuation of the movable work engaging element is effected by a grip lever through an over-center linkage. The movable work engaging element is thereby displaced from a retracted position to a position engaging the work with a snap action. A single spring biases the work engaging element to either of its positions and thereby also yieldably holds the grip lever in either its inactive or actuated position. In the actuated position, a release lever carried by the actuating grip lever is cocked so that it may be operated to rapidly return the grip lever to its inactive position by a camming action for quick release of the clamp.

Accordingly, it is an important object of the present invention to provide a clamp device having a wide size range capability, yet having a rapid work engaging and releasing operating characteristic.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
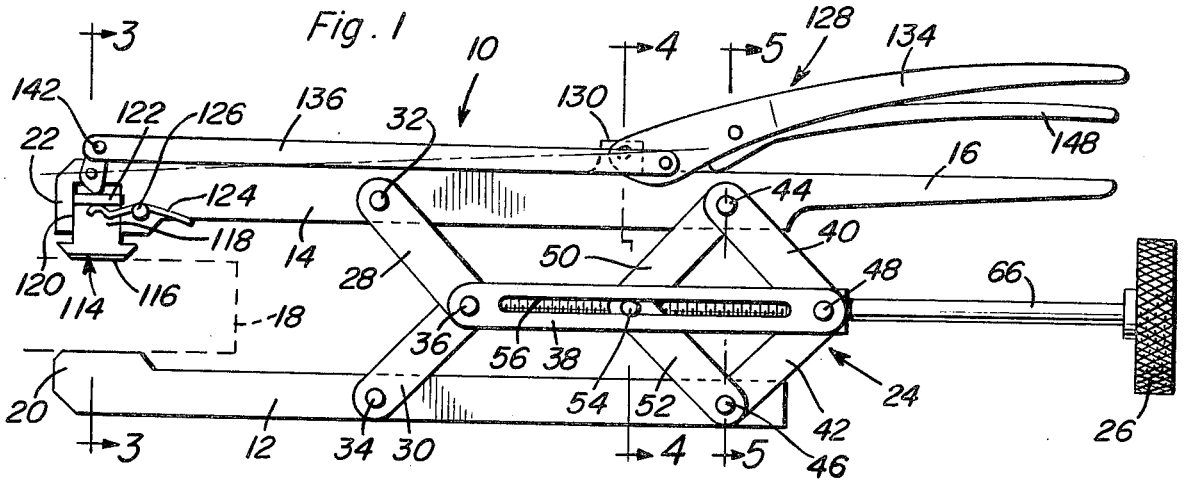
FIG. 1 is a side elevation view of one embodiment of a clamp device constructed in accordance with the present invention.
Figure 2:
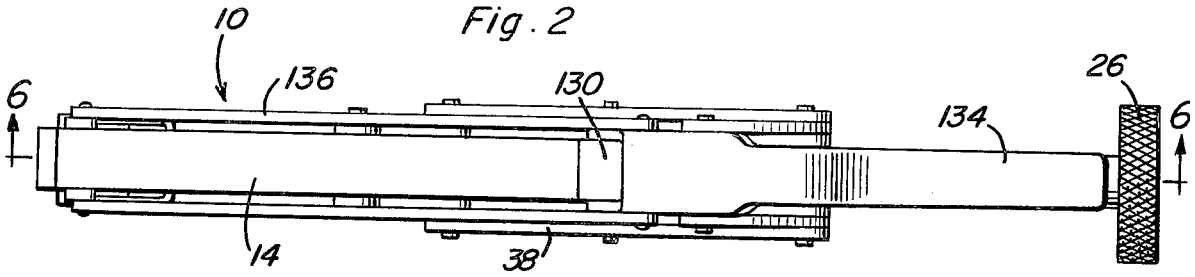
FIG. 2 is a top plan view of the clamp device shown in FIG. 1.
Figure 3:
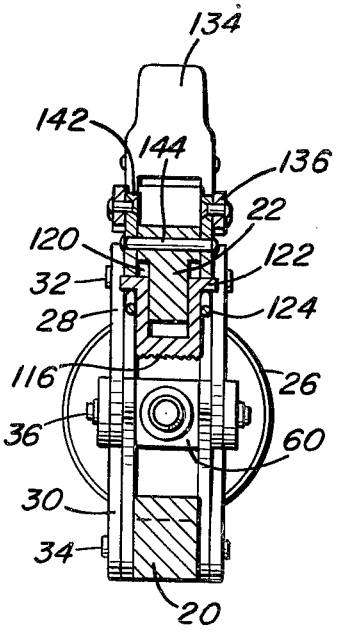
FIGS. 3, 4 and 5 are transverse section views taken substantially through planes indicated by section lines 3—3, 4—4 and 5—5 in FIG. 1.

Referring now to the drawings in detail, and initially to FIGS. 1 and 2, one form of a clamp device is shown generally denoted by reference numeral 10. The clamp body includes an elongated lower jaw member 12 which may be bolted or otherwise secured to a fixed surface or work bench, and an elongated upper jaw member 14 having a rearwardly extending handle portion 16. A workpiece 18, shown in dotted line in FIG. 1, is adapted to be clamped between the forward end portions 20 and 22 of the jaw members. The jaw members are interconnected by a force multiplying mechanism generally referred to by reference numeral 24 having an actuating knob 26. By manually rotating the knob 26, the mechanism 24 is operative to displace the jaw members toward or away from each other with a mechanical advantage. Accordingly, the jaw members may be advanced toward each other to grip the workpiece with the requisite clamping pressure utilizing a relatively small manual effort. However, such movement of the jaw members in a clamping direction or in a releasing direction will be relatively slow and require several turns of the knob.

Figure 4:
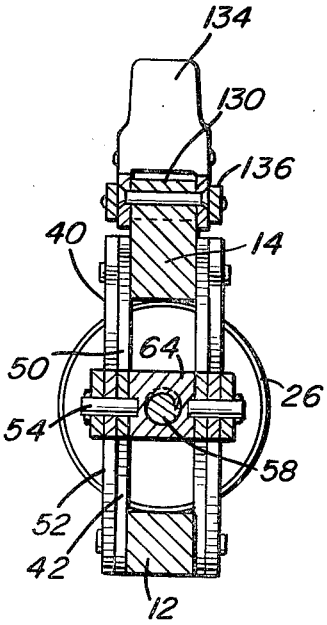
Figure 5:
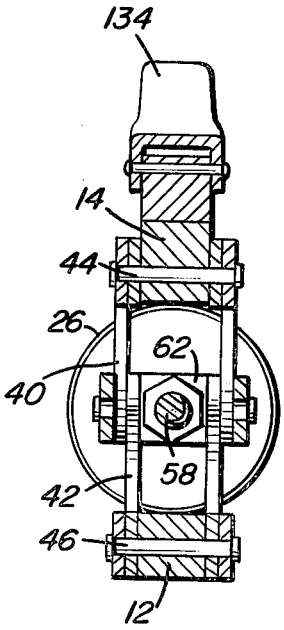
Figure 6:
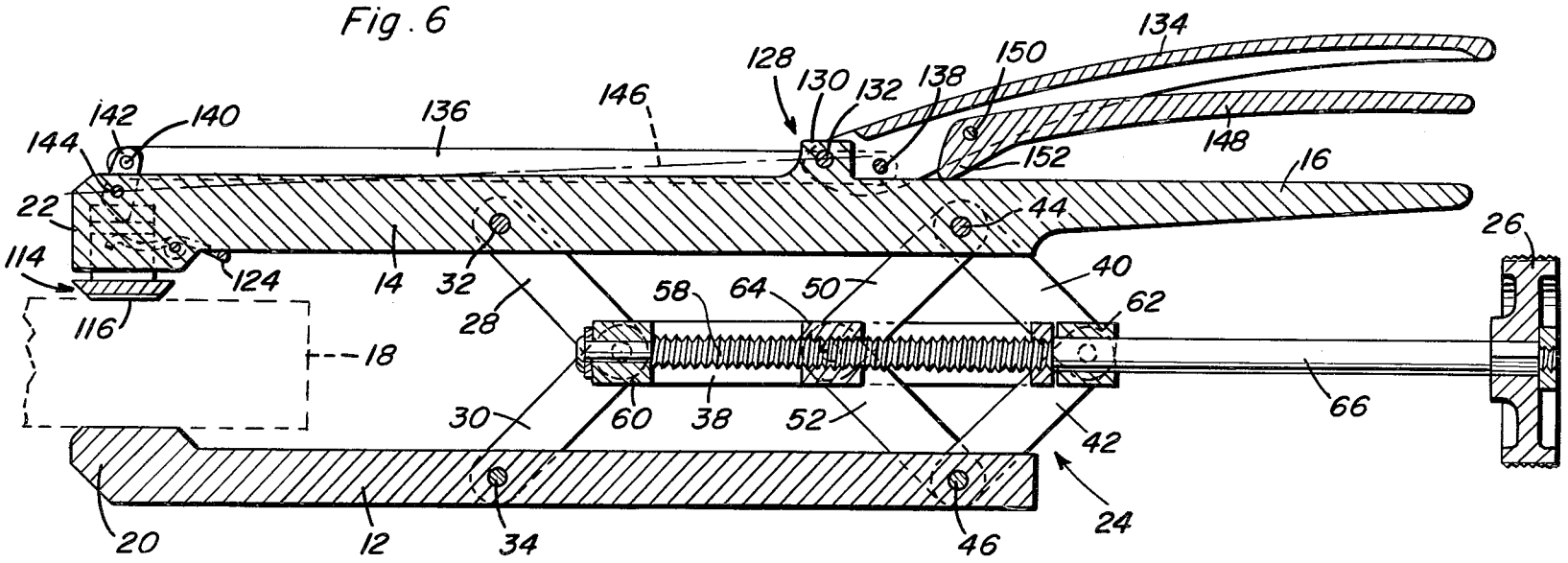
FIG. 6 is an enlarged side section view taken substantially through a plane indicated by section line 6—6 in FIG. 2.

As more clearly seen in FIGS. 1 and 6, the mechanism 24 includes pairs of links 28 and 30 pivotally connected to either side to the jaw members by pivot pins 32 and 34. The links 28 and 30 are pivotally interconnected between the jaw members by pivot pins 36 carried by a forward end portion of a connecting bar 38. Similarly, pairs of links 40 and 42 are pivotally connected to the jaw members by pivot pins 44 and 46 and interconnected with each other by a pivot pin 48 carried by the rear end portion of the connecting bar 38. A third set of links 50 and 52 are connected to the pivot pins 44 and 46 and interconnected to each other by pivot pins 54 guided for longitudinal movement in slots 56 formed in the connecting bar 38. The links 28, 30, 40, 42, 50 and 52 and the connecting bar 38 thus form a lazy-tong linkage actuated by a screw element 58 which is rotatably received by block sections 60 and 62 at the forward and rear end portions of the connecting bar and threadedly received by the movable nut element 64 from which the pivot pins 54 extend, as more clearly seen in FIGS. 4-6. The screw element 58 is connected by a drive shaft section 66 to the actuating knob 26.

Figure 12:
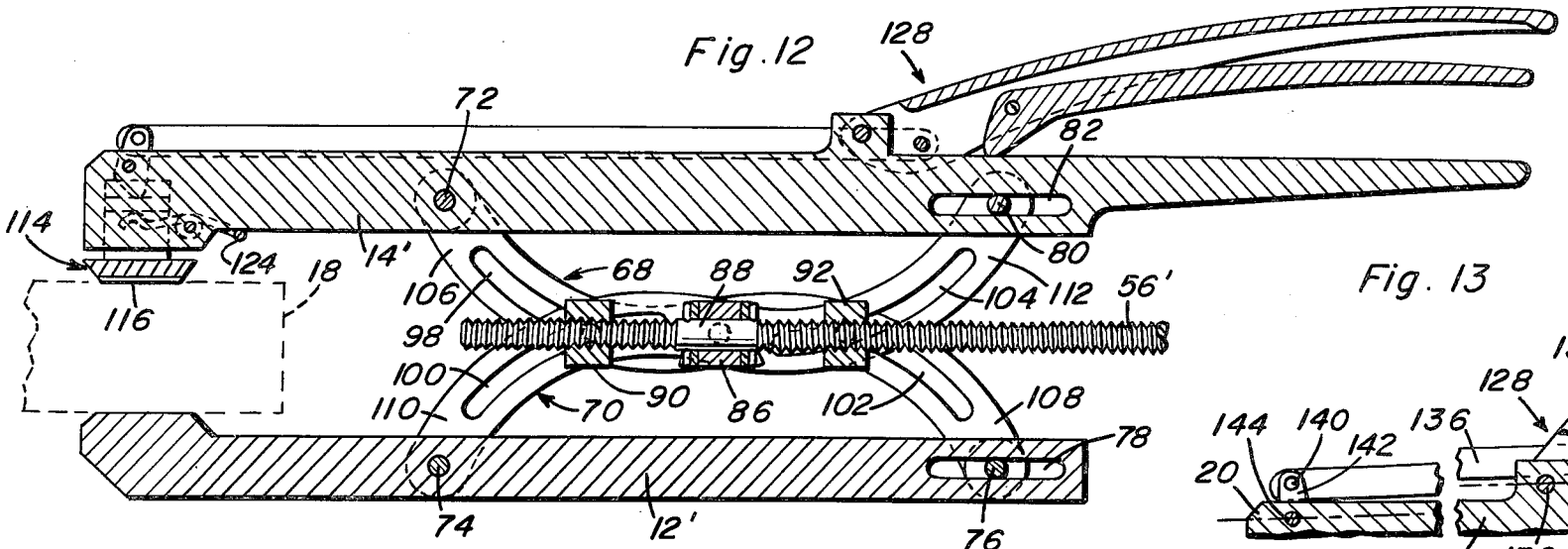
FIG. 12 is an enlarged side section view taken substantially through a plane indicated by section line 12—12 in FIG. 11.
Figure 7:
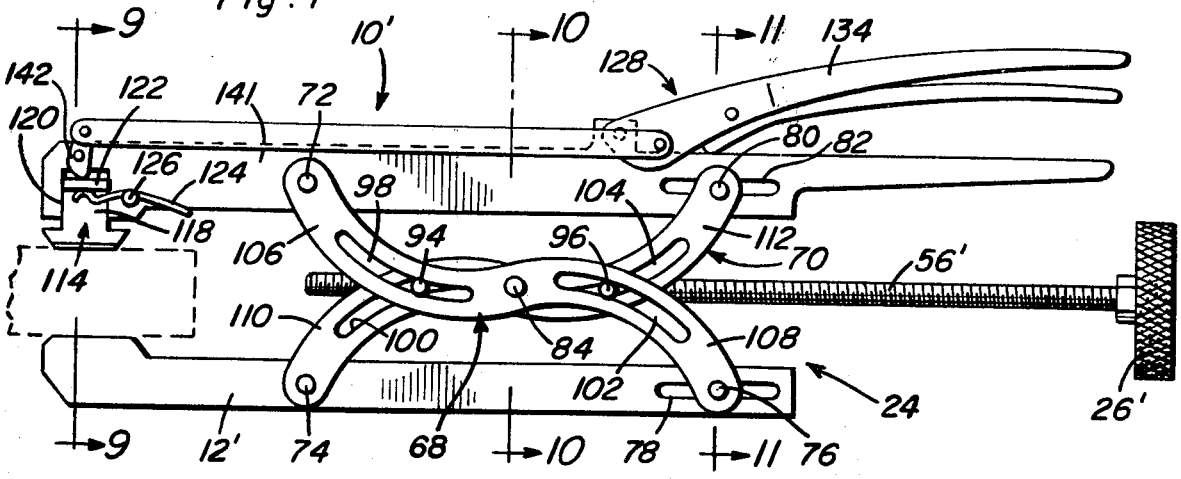
FIG. 7 is a side elevation view of another embodiment of the clamp device.
Figure 8:
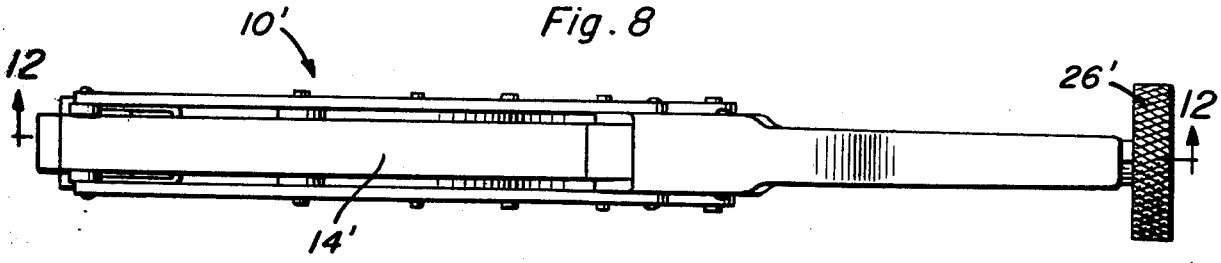
FIG. 8 is a top plan view of the clamp device shown in FIG. 7.
Figure 9:
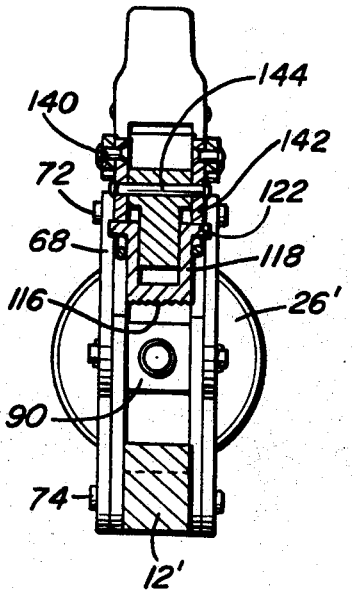
FIGS. 9, 10 and 11 are transverse section views taken substantially through planes indicated by section lines 9—9, 10—10 and 11—11 in FIG. 8.
Figure 10:
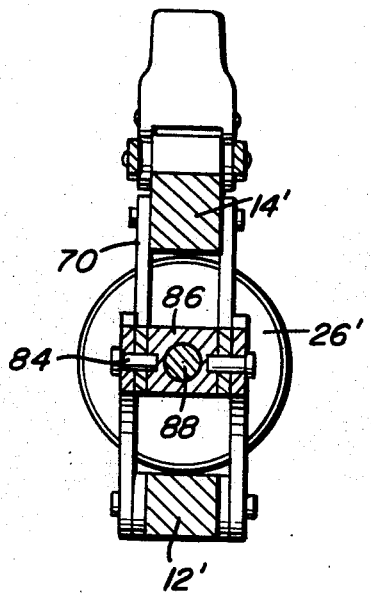
Figure 11:
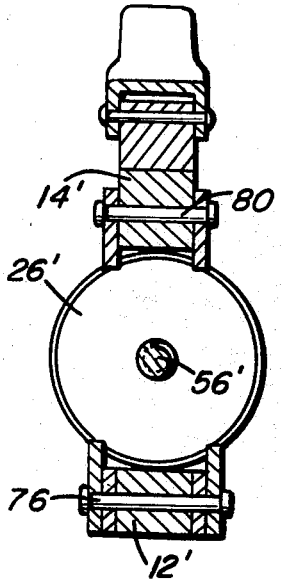

The clamp device 10', shown in FIGS. 7 through 12, is identical to the clamp device 10 hereinbefore described except for the force multiplying mechanism 24'. The mechanism 24' is actuated in the same manner as mechanism 24 by rotation of a knob 26' through a rotatable screw element 56' to displace the lower and upper jaw members 12' and 14' relative to each other. Pairs of links 68 and 70 are respectively connected on opposite sides to the jaw members 12' and 14' by pivot pins 72 and 74. The links 68 are also connected by pin and slot connection 76–78 to the lower jaw member while a pin 80 and a slot 82 connects the links 70 to the upper jaw member in rearwardly spaced relation to the pivot pins 72 and 74. The links 68 and 70 are also interconnected with each other between the jaw members by pivot pins 84 extending laterally from a block 86 rotatably supporting a non-threaded section 88 of the screw element 56', as more clearly seen in FIG. 12. The screw element is threadedly received in nut elements 90 and 92 from which pins 94 and 96 extend laterally into intersecting, arcuate slots 98 and 100 and 102 and 104 formed in overlapping arcuate portions of the links 68 and 70. Thus, each link 68 includes arcuate portions 106 and 108 of opposite curvature on opposite longitudinal sides of the pivot pin 84, while link 70 includes arcuate portions 110 and 112 of opposite curvature, as shown in FIGS. 7 and 12. The threads on opposite axial sides of the non-threaded section 88 of the screw element 56' are of reverse pitch so that the nut elements will be axially displaced in opposite directions upon rotation of the knob 26' to cause the links 68 and 70 to pivot relative to each other about the pivot pins 84 and displace the jaw members relative to each other while maintaining their parallel relationship as in the case of the jaws 12 and 14 of the clamp device 10. This movement of the jaw members is also effected with a high mechanical advantage so as to exert the requisite clamping pressure on the workpiece 18.

Also associated with the upper jaw member of each of the described clamp devices is a movable work engaging element 114 having a pressure applying surface portion 116 confronting the forward end portion of the lower jaw member. Laterally spaced guide portions or furcations 118 are slidably received in guide recesses 120 formed in the sides of the upper jaw member at the forward end portion. Flanges 122 extend laterally from the work engaging element 114 against which a spring 124 reacts to upwardly bias the element 114 to its retracted position. The spring 124 is anchored to the upper jaw member by a pin 126 and reacts against the underside thereof just rearwardly of the forward end portion, as more clearly seen in FIG. 1 or 7. The work engaging element is projected from its retracted position to the clamping position shown, with a snap action, by a manual operating mechanism generally referred to by reference numeral 128, which is also operative to rapidly return the element 114 to its retracted position under the selective control of the operator.

Figure 13:
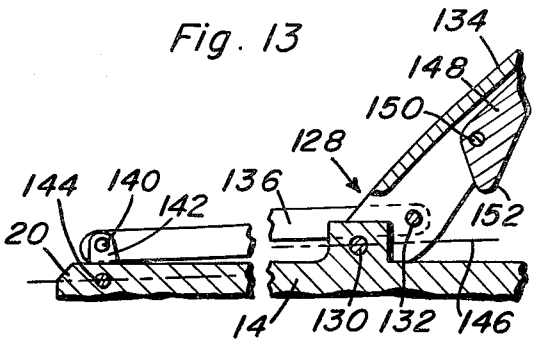
FIG. 13 is a partial side section view similar to FIGS. 6 and 12 showing the clamp device in a release condition.

As more clearly seen in FIG. 6 or 12, the upper jaw member is formed with a pivot support 130 carrying a pivot pin 132 through which a grip lever 134 is pivotally mounted in rearwardly spaced relation to the forward end portion of the jaw member, overlying the handle portion 16. Connecting links 136 are connected to the grip lever 134 by pivot pin 138 in rearwardly spaced relation to the jaw mounted pivot pin 132 while the forward ends of the links 136 are connected by pin 140 to the upper ends of a pair of cam elements 142 having lower lobe portions engaging the upper flanged end of the movable work engaging element 114. The cam elements are pivotally mounted at the forward end portion of the upper jaw member by a pivot pin 144. The cam elements 142, links 136 and grip lever 134 form an over-center linkage since the pivot pin 138 is displaced by the grip lever transversely across a line 146 extending through the pivot points on the jaw member established by pivot pins 132 and 144. Such over-center movement of the grip lever is resisted by the spring 124 acting through the work engaging element on the cam elements 142 to thereby yieldably hold the grip lever in the actuated position shown in FIG. 6 or in the release position shown in FIG. 13 corresponding to the retracted position of the work engaging element 114.

A release lever 148 is pivotally connected to the underside of the grip lever 134 by a pivot pin 150 spaced rearwardly of the pivot pin 138. A cam formation 152 at the forward end of the release lever is brought into engagement with the upper surface of the upper jaw member when the grip lever is displaced downwardly or clockwise, is viewed in FIG. 6, to actuate the work engaging element with a snap action as the pivot pin 138 passes the line 146 during over-center travel. Engagement of the cam formation 152 with the jaw member pivotally displaces the release lever 148 clockwise relative to the grip lever 134 to cock the release lever. Thus, by squeezing the release lever counterclockwise toward the grip lever in its actuated position, the cam formation 152 will cam the grip lever upwardly or counterclockwise to the position shown in FIG. 13 with a mechanical advantage for effortless and rapid retraction of the work engaging element and release of the clamp device.

After the clamp device is adjusted by means of the force multiplying mechanism 24 or 24' to bring the jaw members into proximity of the material 18 being clamped, the work engaging element 114 is actuated with a snap action by squeezing the grip lever 134 toward the handle portion 16 of the jaw member. The adjusted spacing between the workpiece and the jaws must, of course, be less than the strobe of the work engaging element. Once the grip lever is actuated, the release lever 148 is cocked for quick release of the clamp device. Thus, after initial adjustment, rapid clamping and releasing operations may be effected in an effortless manner.

The foregoing is considered as illustrative only of the principles of the invention. Further, since numerous modifications an changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination with a clamping device for workpieces or the like having a pair of operatively interconnected jaws and force multiplying means for displacing the jaws relative to each other; the improvement including a work engaging element movably mounted on one of the jaws in confronting relation to the other of the jaws, over-center linkage means mounted on said one of the jaws and engageable with said work engaging element for displacement thereof from a retracted position toward the other of the jaws, operating means mounted on said one of the jaws for actuating the linkage means in response to over-center movement, spring means operatively engageable with the work engaging element for yieldably resisting said over-center movement of the operating means, release means selectively engageable with said one of the jaws for imparting over-center movement to the operating means against the bias of the spring means to return the work engaging element to the retracted position, said force multiplying means including a pair of links, means pivotally connecting each of said links between the jaws, each of said links having arcuate sections of opposite curvature, means pivotally interconnecting said links between the arcuate sections, a pair of nut elements, pin and slot connecting means interconnecting said nut elements with overlapping arcuate sections of said links, and actuating screw means threadedly engageable with said nut elements.

2. The combination of claim 1 wherein said linkage means comprises a pair of longitudinally spaced pivots mounted on said one of the jaws, a cam connected to one of said pivots and engaged with the work engaging element, a connecting link transmitting force between said cam and the operating means, and connecting pins interconnecting the link with the same and the operating means, the operating means being connected to said one of the jaws by said other of the pivots and the connecting pin between the link and the operating means being displaceable by the operating means during over-center movement across an over-center line intersecting both of the pivots.

3. The combination of claim 2 wherein said operating means comprises a grip lever.

4. The combination of claim 3 wherein said release means comprises a lever element pivotally mounted on the operating means having a cam formation engageable with said one of the jaws.

5. The combination of claim 4 wherein the pivotal connecting means associated with each of the links comprises a fixed pivot connection between one of the jaws and one of the arcuate sections and a pin and slot connection between the other of the arcuate sections and the other of the jaws.

6. The combination of claim 1 wherein said release means comprises a lever element pivotally mounted on the operating means having a cam formation engageable with said one of the jaws.

7. The combination of claim 6 wherein the pivotal connecting means associated with each of the links comprises a fixed pivot connection between one of the jaws and one of the arcuate sections and a pin and slot connection between the other of the arcuate sections of the other of the jaws.

8. A clamping device for workpieces comprising a pair of jaws, a pair of links, means pivotally connecting each of said links to the jaws, each of said links having arcuate sections of opposite curvature, means pivotally interconnecting said links between the arcuate sections, a pair of nut elements, pin and slot connecting means interconnecting said nut elements with overlapping arcuate sections of said links, and actuating screw means threadedly engageable with said nut elements.

9. The combination of claim 8 wherein the pivotal connecting means associated with each of the links comprises a fixed pivot connection between one of the jaws and one of the arcuate sections and a pin and slot connection between the other of the arcuate sections and the other of the jaws.

10. A clamping device for workpieces comprising a pair of spaced apart opposing jaws, force multiplying means interconnecting the jaws for relative displacement of said jaws toward and away from each other, a work engaging element movably mounted on one of the jaws in confronting relation to the other of the jaws, actuating means operatively connected to said work engaging element for displacement thereof between retracted and clamping positions, said one jaw and said work engaging element including first coacting means supporting said element from said one jaw for guided movement of said element relative to said one jaw toward and away from the other jaw and second coacting abutment means establishing a limit position of movement of said element relative to said one jaw away from the other jaw, disconnectable spring means operatively connected between said element and said one jaw yieldingly biasing said element toward said limit position, said first coacting means including relatively telescoped portions of said element and said one jaw readily disengageable with each other upon disconnection of said spring means and movement of said element, relative to said first jaw, in excess of a predetermined amount away from said limit position and toward said other jaw, said one jaw including opposite side outwardly opening recesses extending toward and away from said other jaw and opening endwise outwardly toward said other jaw, said element including a pair of spaced furcations slidably and guidingly received in said recesses, said recesses and furcations comprising said first coacting means and defining said relatively telescoped portions.

11. The combination of claim 10 wherein said force multiplying means comprises a lazy-tong linkage interconnecting the jaws.

12. A clamping device for workpieces comprising a pair of spaced apart opposing jaws, force multiplying means interconnecting the jaws for relative displacement of said jaws toward and away from each other, a work engaging element movably mounted on one of the jaws in confronting relation to the other of the jaws, actuating means operatively connected to said work engaging element for displacement thereof between retracted and clamping positions, said force multiplying means including a pair of links, means pivotally connecting each of said links to the jaws, each of said links having arcuate sections of opposite curvature, means pivotally interconnecting said links between the arcuate sections, a pair of nut elements, pin and slot connecting means interconnecting said nut elements with overlapping arcuate sections of said links, and actuating screw means threadedly engageable with said nut elements.

* * * * *